US010180114B1

(12) United States Patent
Maki et al.

(10) Patent No.: US 10,180,114 B1
(45) Date of Patent: Jan. 15, 2019

(54) SELECTIVE SURFACE POROSITY FOR CYLINDER BORE LINERS

(71) Applicant: FORD GLOBAL TECHNOLOGIES, LLC, Dearborn, MI (US)

(72) Inventors: Clifford E. Maki, New Hudson, MI (US); Larry Dean Elie, Ypsilanti, MI (US); James Douglas Ervin, Novi, MI (US); Timothy George Beyer, Troy, MI (US); Hamed Ghaednia, West Bloomfield, MI (US); James Maurice Boileau, Novi, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 0 days.

(21) Appl. No.: 15/646,708

(22) Filed: Jul. 11, 2017

(51) Int. Cl.

| | |
|---|---|
| ***F02F 1/00*** | (2006.01) |
| ***B05D 1/08*** | (2006.01) |
| ***B05D 3/12*** | (2006.01) |
| ***B05D 7/22*** | (2006.01) |
| ***B05D 7/14*** | (2006.01) |
| ***B24B 29/08*** | (2006.01) |
| ***B24B 27/033*** | (2006.01) |
| ***B24C 3/32*** | (2006.01) |
| ***B24C 1/00*** | (2006.01) |
| ***B24B 33/02*** | (2006.01) |
| ***B05D 1/02*** | (2006.01) |

(52) U.S. Cl.
CPC ..... *F02F 1/004* (2013.01); *B05D 1/02* (2013.01); *B05D 1/08* (2013.01); *B05D 3/12* (2013.01); *B05D 7/14* (2013.01); *B05D 7/22* (2013.01); *B24B 27/033* (2013.01); *B24B 29/08* (2013.01); *B24B 33/02* (2013.01); *B24C 1/003* (2013.01); *B24C 3/32* (2013.01); *B24C 3/325* (2013.01); *B05D 2202/00* (2013.01); *B05D 2254/04* (2013.01); *F02F 2200/00* (2013.01)

(58) Field of Classification Search
CPC ..... F02F 1/004; F02F 2200/00; B24B 33/02; B24B 27/033; B24B 29/08; B24C 1/003; B24C 3/32; B24C 3/325; B05D 1/02; B05D 1/08; B05D 3/12; B05D 7/14; B05D 7/22; B05D 2202/00; B05D 2254/04
USPC ..... 451/27, 51, 61, 180, 39, 76; 241/14; 134/93, 107; 123/193.2; 427/446, 230, 427/236, 237, 239, 255.28, 348, 355, 367, 427/404, 405, 419.1, 419.2, 427.2, 427.3
See application file for complete search history.

(56) References Cited

U.S. PATENT DOCUMENTS

| | | | | |
|---|---|---|---|---|
| 4,980,996 | A | 1/1991 | Klink et al. | |
| 5,344,494 | A | 9/1994 | Davidson et al. | |
| 5,380,564 | A * | 1/1995 | Vankuiken, Jr. | C23C 4/02 427/328 |
| 5,441,439 | A | 8/1995 | Grimm et al. | |
| 5,592,927 | A | 1/1997 | Zaluzec et al. | |
| 5,820,938 | A | 10/1998 | Pank et al. | |
| 5,932,026 | A | 8/1999 | Trampusch | |
| 6,041,749 | A | 3/2000 | Lubbing et al. | |
| 6,379,754 | B1 | 4/2002 | Schlegel et al. | |
| 6,701,882 | B2 | 3/2004 | Barbezat | |
| 7,104,240 | B1 * | 9/2006 | Vuk | F02F 1/20 123/193.2 |
| 7,685,991 | B2 | 3/2010 | Cumming et al. | |
| 8,220,124 | B1 | 7/2012 | Morasch et al. | |
| 8,286,468 | B2 | 10/2012 | Nishimura et al. | |
| 8,726,874 | B2 | 5/2014 | Whitbeck et al. | |
| 9,387,567 | B2 * | 7/2016 | Cryer | F16J 10/04 |
| 9,556,819 | B2 | 1/2017 | Ernst et al. | |
| 2007/0071990 | A1 * | 3/2007 | Suman | B23K 35/36 428/548 |
| 2010/0288222 | A1 | 11/2010 | Urabe et al. | |
| 2012/0132069 | A1 | 5/2012 | Roh | |
| 2013/0131824 | A1 | 5/2013 | Meehan et al. | |
| 2013/0340700 | A1 | 12/2013 | Donahue | |
| 2017/0175668 | A1 | 6/2017 | Schepak et al. | |
| 2017/0260926 | A1 * | 9/2017 | Maki | C23C 4/129 |
| 2018/0058370 | A1 * | 3/2018 | Amano | F02F 1/10 |

FOREIGN PATENT DOCUMENTS

| | | | |
|---|---|---|---|
| DE | 19711756 | A1 | 9/1998 |
| EP | 1832381 | A1 | 9/2007 |

OTHER PUBLICATIONS

Guo, Z. et al, "Study on Influence of Cylinder Liner Surface Texture on Lubrication Performance for Cylinder Liner-Piston Ring Components," Tribology Letters, Jul. 2013, v. 51, issue 1., 21 pgs.
Maki, C.E et al. (Inventors), U.S. Appl. No. 15/064,903, filed Mar. 9, 2016, 28 pgs.

* cited by examiner

*Primary Examiner* — William P Fletcher, III
(74) *Attorney, Agent, or Firm* — Marla Johnston; Brooks Kushman P.C.

(57) ABSTRACT

A method includes spraying a coating on to an engine bore surface, honing the coated surface to create a honed surface region, and cleaning the honed surface region to remove material from the surface pores. The honed surface region includes a plurality of surface pores and upper, middle, and lower regions. Cleaning the honed surface region produces upper, middle, and lower region surface porosities, with the middle region porosity being greater than at least one of the upper and lower porosities.

20 Claims, 3 Drawing Sheets

SELECTIVE SURFACE POROSITY FOR CYLINDER BORE LINERS

TECHNICAL FIELD

The present disclosure relates to selective surface texture of cylinder liners, and a method of cleaning cylinder liners.

BACKGROUND

Engine blocks (cylinder blocks) may include one or more cylinder bores that house pistons of an internal combustion engine. Engine blocks may be cast, for example, from cast iron or aluminum. Aluminum is lighter than cast iron, and may be chosen in order to reduce the weight of a vehicle and improve fuel economy. Aluminum engine blocks may include a liner, such as a cast iron liner. If liner-less, the aluminum engine block may include a coating on the bore surface. Cast iron liners generally increase the weight of the block and may result in mismatched thermal properties between the aluminum block and the cast iron liners. Liner-less blocks may receive a coating (e.g., a plasma coated bore process) to reduce wear and/or friction.

The inner surface of each cylinder bore is machined prior to coating so that the surface is suitable for use in automotive applications with suitable wear resistance and strength. The machining process may include roughening the inner surface, applying a metallic coating to the roughened surface, honing the metallic coating to obtain a finished inner surface, and cleaning the inner surface to remove burrs and debris.

SUMMARY

According to an embodiment, a method comprising spraying a coating on to an engine bore surface, honing the coated surface to create a honed surface region, and cleaning the honed surface region to remove material from the surface pores is disclosed. The honed surface region includes a plurality of surface pores and upper, middle, and lower regions. Cleaning the honed surface region produces upper, middle, and lower region surface porosities, with the middle region porosity being greater than at least one of the upper and lower porosities.

According to one or more embodiments, the middle region average porosity may be greater than the upper region porosity and the lower region porosity. In one or more embodiments, the cleaning step may include spraying a pressurized fluid on to the honed surface region. Spraying in the cleaning step may include spraying the pressurized fluid through a nozzle with multiple controlled apertures of different diameters. Spraying in the cleaning step may include moving a nozzle with a single aperture relative to the engine bore surface and varying spray pressure of the pressurized fluid based on the region. In another embodiment, the cleaning step may include masking at least one region of the honed surface and removing the material from surface pores in an unmasked region via gaseous combustion. In other embodiments, the cleaning step may include spraying an abrasive high pressure fluid on to the honed surface region and varying spray pressure based on the region. The abrasive high pressure fluid may be compressed air or a dry ice blast.

According to an embodiment, a method comprising spraying a coating on to an engine bore surface, honing the coated surface to create a honed surface region having a plurality of surface pores, and cleaning the honed surface to selectively remove material from the surface pores is disclosed. The honed surface region includes a first and second region. Cleaning the honed surface region produces a first region average surface porosity greater than a second region average surface porosity.

According to one or more embodiments, the first region may be a middle region of the honed surface region, and the second region may be an upper and lower ring of the honed surface region. In one or more embodiments, the cleaning step may include spraying a pressurized fluid on to the honed surface region. Spraying in the cleaning step may include spraying the pressurized fluid through a nozzle with multiple controlled apertures of different diameters. Spraying in the cleaning step may include moving a nozzle with a single aperture relative to the engine bore surface and varying spray pressure of the pressurized fluid based on the region. In another embodiment, the cleaning step may include masking one region of the honed surface region and removing the material from surface pores in an unmasked region via gaseous combustion. In other embodiments, the cleaning step may include spraying an abrasive high pressure fluid on to the honed surface region and varying spray pressure based on the region. The abrasive high pressure fluid may be compressed air or a dry ice blast.

According to an embodiment, a method comprising spraying a coating on to an engine bore surface; honing the coated surface to create a honed surface region having a plurality of surface pores and upper, middle, and lower regions; and cleaning the honed surface region to remove material from the surface pores from the middle region is disclosed.

According to one or more embodiments, the middle region may be a majority of the honed surface region, and the upper and lower regions may be upper and lower rings of the honed surface region. In one or more embodiments, the cleaning step may include selectively spraying a pressurized fluid or an abrasive pressurized fluid on to the middle region. In another embodiment, the cleaning step may include masking the upper and lower regions of the honed surface region and removing the material from surface pores in the middle region via gaseous combustion.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
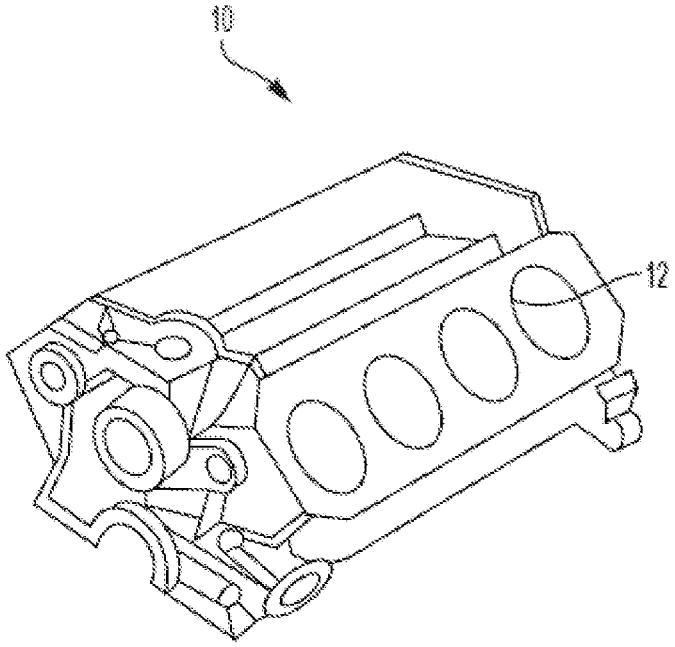
FIG. 1 is a schematic perspective view of an engine block.
Figure 2:
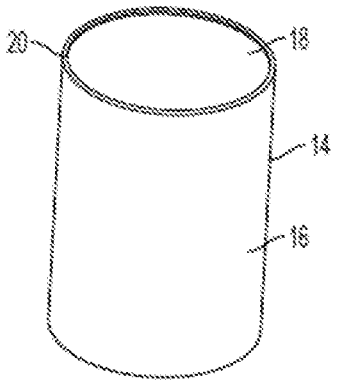
FIG. 2 is a perspective view of a cylinder liner, according to an embodiment.

With reference to FIG. 1, an engine block, or cylinder block, 10 is shown. The engine block 10 may include one or more cylinder bores 12, which may be configured to house pistons of an internal combustion engine. The engine block body may be formed of any suitable material, such as aluminum, cast iron, magnesium, or alloys thereof. In at least one embodiment, the engine block 10 is a liner-less engine block. In these embodiments, the bores 12 may have a coating thereon. In at least one embodiment, the engine block 10 may include cylinder liners 14, such as shown in FIG. 2, inserted into or cast-in to the bores 12. The liners 14 may be a hollow cylinder or tube having an outer surface 16, an inner surface 18, and a wall thickness 20.

If the engine block parent material is aluminum, then a cast iron liner or a coating may be provided in the cylinder bores to provide the cylinder bore with increased strength, stiffness, wear resistance, or other properties. For example, a cast iron liner may be cast-in to the engine block or pressed into the cylinder bores after the engine block has been formed (e.g., by casting). In another example, the aluminum cylinder bores may be liner-less but may be coated with a coating after the engine block has been formed (e.g., by casting). In another embodiment, the engine block parent material may be aluminum or magnesium and an aluminum or magnesium liner may be inserted or cast-in to the engine bores. Casting in of an aluminum liner into an aluminum engine block is described in U.S. Pub. No. 2017/0175668 published Jun. 22, 2017, the disclosure of which is hereby incorporated in its entirety by reference herein.

Accordingly, the bore surface of the cylinder bores may be formed in a variety of ways and from a variety of materials. For example, the bore surface may be a cast-iron surface (e.g., from a cast iron engine block or a cast-iron liner) or an aluminum surface (e.g., from a liner-less Al block or an Al liner). The disclosed variable coating may be applied to any suitable bore surface, therefore, the term bore surface may apply to a surface of a liner-less block or to a surface of a cylinder liner or sleeve that has been disposed within the cylinder bore (e.g., by interference fit or by casting-in).

Figure 3:
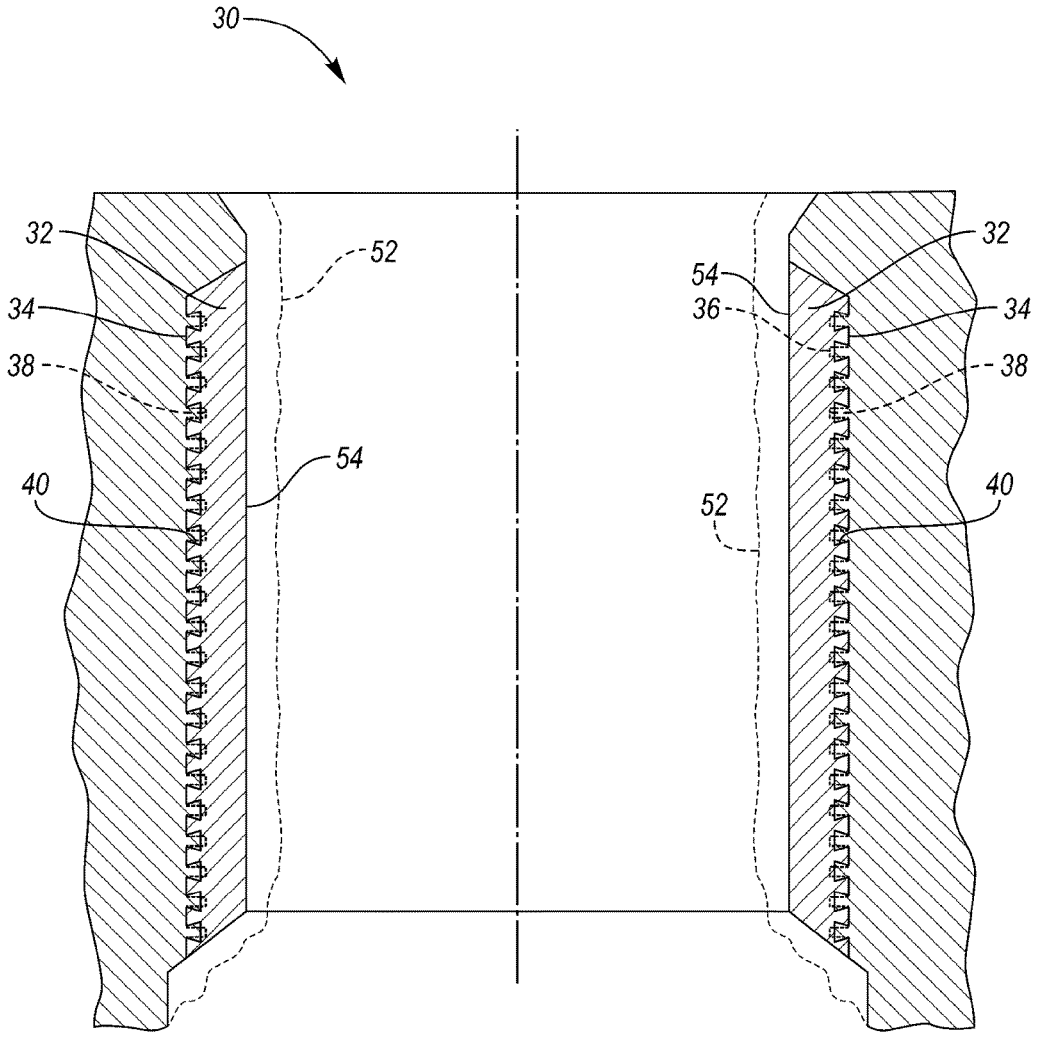
FIG. 3 is a schematic, fragmented cross-section of a coated engine bore, according to an embodiment.

With reference to FIG. 3, a cylinder bore 30 having a coating 32 is disclosed. While a cylinder bore is shown and described, the present disclose may apply to any article comprising a body including at least one sliding surface wall having a longitudinal axis. Prior to applying the coating 32, the bore surface 34 may be roughened. Roughening the bore surface 34 may improve the adhesion or bonding strength of the coating 32 to the bore 30. The roughening process may be a mechanical roughening process, for example, using a tool with a cutting edge, grit blasting, or water jet. Other roughening processes may include etching (e.g., chemical or plasma), spark/electric discharge, or others. In the embodiment shown, the roughening process may be multiple steps. In the first step, material may be removed from the bore surface 34 such that projections 36 are formed (in dashed lines). In the second step, the projections may be altered to form overhanging projections 38 having undercuts 40. The projections may be altered using any suitable process, such as rolling, cutting, milling, pressing, grit blasting, or others.

The coating 32 may be applied to the roughed bore surface. In one embodiment, the coating may be a sprayed coating, such as a thermally sprayed coating. Non-limiting examples of thermal spraying techniques that may be used to form the coating 32 may include plasma spraying, detonation spraying, wire arc spraying (e.g., plasma transferred wire arc, or PTWA), flame spraying, high velocity oxy-fuel (HVOF) spraying, warm spraying, or cold spraying. Other coating techniques may also be used, such as vapor deposition (e.g., PVD or CVD) or chemical/electrochemical techniques. In at least one embodiment, the coating 32 is a coating formed by plasma transferred wire arc (PTWA) spraying.

An apparatus for spraying the coating 32 may be provided. The apparatus may be a thermal spray apparatus including a spray torch. The spray torch may include torch parameters, such as atomizing gas pressure, electrical current, plasma gas flow rate, wire feed rate and torch traverse speed. The torch parameters may be variable such that they are adjustable or variable during the operation of the torch. The apparatus may include a controller, which may be programmed or configured to control and vary the torch parameters during the operation of the torch. As described in U.S. application Ser. No. 15/064,903, filed Mar. 9, 2016, now published as 2017/0260826 on Sep. 14, 2017, the disclosure of which is hereby incorporated in its entirety by reference herein, the controller may be programmed to vary the torch parameters to adjust the porosity of the coating 32, in a longitudinal and/or depth direction. The controller may include a system of one or more computers which can be configured to perform particular operations or actions by virtue of having software, firmware, hardware, or a combination thereof installed on the system that in operation causes or cause the system to perform the disclosed actions. One or more computer programs can be configured to perform particular operations or actions by virtue of including instructions that, when executed by the controller, cause the apparatus to perform the actions.

The coating 32 may be any suitable coating that provides sufficient strength, stiffness, density, wear properties, friction, fatigue strength, and/or thermal conductivity for an engine block cylinder bore. In at least one embodiment, the coating may be an iron or steel coating. Non-limiting examples of suitable steel compositions may include any AISI/SAE steel grades from 1010 to 4130 steel. The steel may also be a stainless steel, such as those in the AISI/SAE 400 series (e.g., 420). However, other steel compositions may also be used. The coating is not limited to irons or steels, and may be formed of, or include, other metals or non-metals. For example, the coating may be a ceramic coating, a polymeric coating, or an amorphous carbon coating (e.g., DLC or similar). The coating type and composition may therefore vary based on the application and desired properties. In addition, there may be multiple coating types in the cylinder bore 30. For example, different coating types (e.g., compositions) may be applied to different regions of the cylinder bore (described in more detail below) and/or the coating type may change as a function of the depth of the overall coating (e.g., layer by layer).

In general, the process of applying the coating 32 and finalizing the bore dimensions and properties may include several steps. First, the bore surface may be prepared to receive the coating. As described above, the bore surface may be a cast engine bore or a liner (cast-in or interference fit), and as such, are hereafter used interchangeably and is not intended to be limiting. The surface preparation may include roughening and/or washing of the surface to improve the adhesion/bonding of the coating. Next, the deposition of the coating may begin. The coating may be applied in any suitable manner, such as spraying. In one example, the coating may be applied by thermal spraying, such as PTWA spraying. The coating may be applied by rotational spraying of the coating onto the bore surface. The spray nozzle, the bore surface, or both may be rotated to apply the coating. As described in U.S. application Ser. No. 15/064,903, the deposition parameters may be adjusted (e.g., by a controller) to produce varying levels of porosity in the coating. The adjustments may be made while the coating is being applied or the application may be paused to adjust the parameters. Additional layers of the coating may be applied using the same or further adjusted deposition parameters.

After the coating is applied, it may be honed to a final bore diameter according to specified engine bore dimensions. In some embodiments, an optional mechanical machining operation, such as boring, cubing, etc., may be performed prior to honing in order to reduce the amount of stock removal during honing. In general, the honing process includes inserting a rotating tool having abrasive particles into the cylinder bore to remove material to a controlled diameter. The abrasive particles may be attached to individual pieces called honing stones, and a honing tool may include a plurality of honing stones. The honing process may include one or more honing steps. If there are multiple honing steps, the parameters of the honing process, such as grit size and force applied, may vary from step to step. In the embodiments shown in FIG. 3, the coating 32 may initially be deposited to an initial thickness 52, shown in a dashed line. The honing process may remove material from the coating 32 and provide a highly cylindrical bore wall 54 having the final bore diameter. As described herein, the coating surface may be the surface that results from the honing process, the honed surface region, not the initial surface after deposition (e.g., the bore wall 54, not the initial thickness 52).

As used herein, the honed surface region may be a region in the coating that includes the surface of the coating and a relatively small depth beneath the surface, for example, up to 5 μm, 10 μm, 25 μm, or 50 μm beneath the surface. It has been found that the porosity (i.e., average surface porosity) of the honed surface region can generally be described by two types of pores, which may be referred to as primary and secondary pores. Primary pores may be those that are generated during the coating process (e.g., spraying). For example, the type of porosity generally referred to in U.S. application Ser. No. 15/064,903. These pores (e.g., porosity and size) may be generally controlled by the coating parameters. Secondary pores may be those that are created or generated after the coating has been deposited.

During the honing process, material that is removed from the coated bore surface or a burr or edge of a pore may be smeared over the pore surface or may fill in the pore. This may result in a lower surface porosity and significantly reduce the oil retention capability of the pore. Accordingly, cleaning processes clean the liner surfaces to reveal the pores. The cleaning process may include performing one or more cleaning passes of the bore coating surface. In one embodiment, the cleaning process may include a high-pressure water spray. The spray may be controlled into a spray pattern, such as a fan spray pattern (e.g., a substantially 2D spray pattern). Other cleaning methods that may be suitable include ice blasting (e.g., water- or CO2-based), brushing, or a very fine abrasive media. These methods are examples, however, and not intended to be limiting.

The cleaning process may remove the material, such as debris or burrs, that are present from previous machining operations, such as previous honing steps or a boring operation. Accordingly, loose material that is present in the pores of the coating may be removed to expose the pores and allow them to retain oil. During certain coating processes, particles of the coating material may be accelerated towards the bore surface, for example, in the form of solid particles (cold spray) or melted globules (hot spray). These particles may build up on each other to form a substantially continuous coating. The particles may generally deform or coalesce to form a relatively uniform coating, however, some particles may remain more discrete or weakly bonded to the coating than others. In addition, in certain areas the layers of the coating may not be completely adhered or adhered as strongly as in other areas. These particles and areas may be potential sites for new pore generation during the cleaning process (e.g., nucleation sites).

The cleaning process may cause de-bonding or delamination of these particles or layers, respectively, or may impart residual stresses in the coating at or near the particles. Accordingly, the cleaning process may perform at least two functions: 1) remove existing debris and burrs from the coating surface and 2) generate nucleation sites on the coating surface. The cleaning process may therefore allow for the honed surface to not only have a similar porosity compared to the bulk of the coating, it may have an increased porosity due to the additionally generated pores. In some embodiments, the cleaning process (or a similar cleaning process) may be repeated after the final honing process to clear out any final debris, remove any burrs, or clean out any other loose material from the bore surface or within the pores.

The use of surface pores and surface porosity to improve oil retention in cylinder bore surfaces, such as cylinder liners or bore walls, requires cleaning processes to remove burrs and debris in order to improve lubricant distribution to reduce hydrodynamic drag and piston ring asperity. While the common cleaning processes are described above, certain pores require a more controlled and selective process to fully maximize reductions in wear and friction. In addition, the cylinder bore may require specific regions with more drag reduction, thus more lubricant retention, such that regions of higher surface porosity, or more pores revealed by cleaning, are required.

According to an embodiment, a selective cleaning process is disclosed. A selective cleaning process removes material from pores in a controlled process to reveal pores to certain degrees in certain areas of the cylinder bore or regions of the honed surface region, resulting in a tailored surface texture. The selective cleaning process uncovers or exposes debris filled or smeared over pores during the honed cylinder surface operation to a certain degree or in certain regions of the bore surface. For example, the cylinder bore surface where the piston ring pack travels is made of specific regions, some requiring a higher average surface porosity than others. By tailoring the cleaning process to specific regions, lubricant deposition can be improved exactly where required by piston ring travel. Generally, majority of the bore surface would benefit from more of the pores being revealed by cleaning, whereas the upper and lower ring reversal regions of the bore surface (or upper and lower regions) may include less revealed pores than the middle (majority) region. By selectively cleaning the honed surface region, surface texturing can be tailored to properly expose pores on the coated surface.

Figure 4:
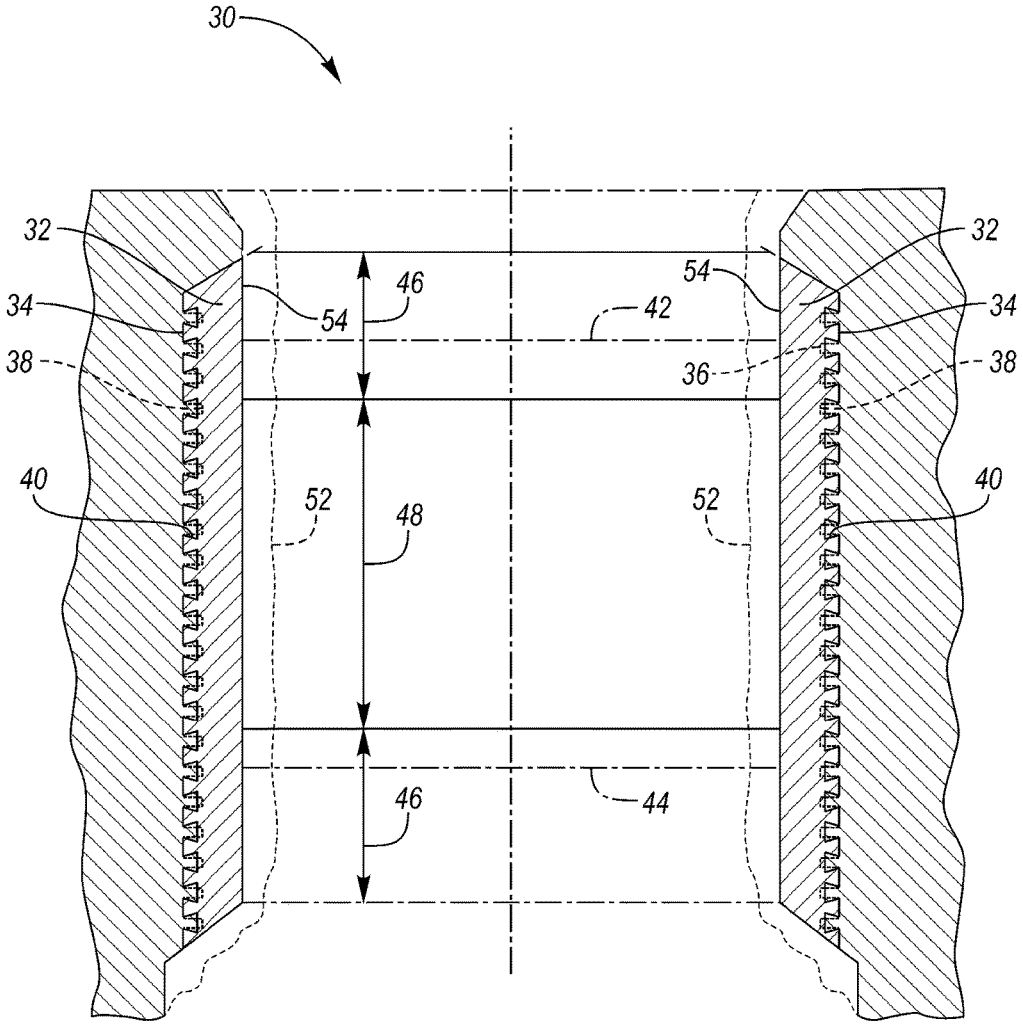
FIG. 4 is a schematic, fragmented cross-section of a coated engine bore, according to an embodiment.

As shown in FIG. 4, a middle region 48 may be disposed between upper and lower regions 46. The middle region 48 may comprise a majority of the cylinder liner or bore wall, or cover a certain height of the cylinder bore according to the crank angle of the piston. Similar to crank angle, the upper and lower region(s) 46 and middle region 48 may cover areas (e.g., height ranges) of the bore surface that correspond to where the piston has a certain velocity. For exemplary purposes, crank angles are discussed for the regions, but other properties may apply as well. Although not illustrated in FIG. 4, the upper and lower regions 46 may or may not be the same height, and may reflect on the upper and lower rings. Therefore, the crank angle ranges may be asymmetrical and may extend from any value disclosed above for the upper region 46 to any region for the lower region 46. For example, the ratio of lengths of the upper, middle, and lower regions may be, but is not limited to, about 0.05:0.9:0.05 to 0.1:0.8:0.1, or about 0.05:0.9:0.05 to 0.15:0.7:0.15, respectively. In other embodiments where the upper and lower regions 46 may not be the same height, the ratio of lengths of the upper, middle, and lower regions may be, for example, but is not limited about 0.03:0.9:0.07 to 0.08:0.8:0.12, or about 0.07:0.9:0.03 to 0.12:0.8:0.08. In an embodiment, the upper and lower regions 46 may comprise, for example, at least 1%, 2%, 3%, 4%, 5%, 6%, 7%, 8%, 9% or 10% of the honed surface region collectively, and up to 10%, 15%, 20%, 25% or 30% of the honed surface region, collectively. In some embodiments, the upper and lower regions 46 may each individually be, for example, at least 1%, 2% or 3%, and at most about 5%, 10%, or 15% of the honed surface region, and may or may not be the same percent of the honed surface region.

In one embodiment, the surface porosity (e.g., average surface porosity) of the upper and lower regions 46 may have an average surface porosity of up to 3%. For example, the upper and lower regions 46 may have a porosity of, but is not limited to, up to 2.5%, 2%, or 1.5%. In one embodiment, the upper and lower regions 46 may have a honed surface porosity of 0.1% to 3%, or any sub-range therein, such as 0.5% to 3%, 0.5% to 2.5%, 0.5% to 2%, 1% to 2.5%, or 1% to 2%. As disclosed herein, "average surface porosity" may refer to a surface porosity, or a percentage of the surface of the coating that is made up of pores (e.g., empty space or air, prior to introduction of lubricant).

The surface porosity of the middle region 48 may be greater than the surface porosity of the upper and/or lower region(s) 46. In one embodiment, the middle region 48 may have a surface porosity (e.g., average surface porosity) of at least 2%, for example, at least 3%, 4%, 5%, 6%, 7%, 8%, 9%, 10%, 15%, or 20%. In another embodiment, the middle region 48 may have a surface porosity of, but is not limited to, 2% to 20%, or any sub-range therein, such as 3% to 20%, 5% to 20%, 10% to 20%, 2% to 15%, 3% to 15%, 5% to 15%, 7% to 15%, 3% to 12%, 3% to 10%, 4% to 10%, 5% to 10%, or 5% to 8%.

The size or diameter of the pores, the pore depth, and/or the pore distribution in the low and high honed surface porosity regions may be the same or may be different based on the selective cleaning process revealing the pores in the region(s). In one embodiment, the mean or average pore sizes of the upper/lower regions 46 and the middle region 48 may be the same or similar, while the surface porosities are different based on the selective cleaning process. The average pore sizes of the upper/lower regions 46 and the middle region 48 may be from, but is not limited to, 0.1 to 750 μm, or any sub-range therein, such as 0.1 to 500 μm, 0.1 to 250 μm, 0.1 to 200 μm, 1 to 750 μm, 1 to 500 μm, 1 to 300 μm, 1 to 200 μm, 10 to 300 μm, 10 to 200 μm, 20 to 200 μm, 10 to 150 μm, or 20 to 150 μm. In another embodiment, the pores may be selectively revealed during the cleaning process based on diameter or pore depth, but is not limited to, about 10% to 95%, about 15% to 90%, about 20% to 85%, or about 25% to 80% of size/depth to obtain a selective surface texture. In another embodiment, the pore distribution based on the surface porosity may be selectively revealed based on the region(s). Certain areas may have a higher percentage of pores revealed. For example, pores in the upper and lower regions may be revealed to a surface porosity of about 0.1% to 3%, whereas the middle region may be revealed to a surface porosity of about 2% to 20%. To achieve the surface porosities, the cleaning process may reveal pores within the selected regions based on the diameter or pore depth, about 10% to 95%, about 15% to 95%, about 20% to 95%, about 25% to 95%, about 10% to 90%, about 15% to 90%, about 20% to 90%, about 25% to 90%, about 10% to 85%, about 15% to 85%, about 20% to 85%, about 25% to 85%, about 10% to 80%, about 15% to 80%, about 20% to 80%, or about 25% to 80%. In other embodiments, the pore size/depth may remain uniform throughout the regions, but more pores may be selectively revealed in the middle region 48, compared to the upper/lower regions 46, to achieve the desired surface porosity.

The selective cleaning step may include processes such as high pressure fluid (e.g., air or water) spraying, ice blasting, or mechanical cleaning (e.g., brushing). Accordingly, increasing or decreasing the intensity of the cleaning process at various locations within the cylinder bore may affect the degree of revealing the pores in the honed surface region. In one embodiment, increasing the intensity of the cleaning process may increase the removal of material from pores, and vice versa. Increasing the intensity at various regions of the cylinder bore can change the surface porosity of the honed surface region, as more or less pores are revealed between regions. For example, if a high pressure water jet is used, increasing the pressure of the jet through a particular region may increase the intensity of the cleaning pass. Similarly, if mechanical cleaning is used, the force applied may be increased, the speed of the cleaning may be increased, or other parameters that make the cleaning more intense in specific regions of the cylinder bore. Another way to increase or decrease the intensity may be to vary the number of cleaning passes in the cleaning process. Additional cleaning passes may cause more material removal, while fewer may reduce it. Changing the intensity of cleaning by region provides a controlled approach of cleaning the cylinder bores to achieve a selective surface texture of the honed surface.

According to an embodiment, to implement the tailored cleaning method for a selective surface texture, a high pressure fluid may be applied through a pressurized nozzle. In some embodiments, the pressurized nozzle may include multiple controlled apertures of different diameters to create different pressures to reveal surface pores to different degrees. In other embodiments, the pressurized nozzle may include a single aperture that is moved relative to the liner, and pressure is varied depending on the nozzle position in the liner to reveal pores to different degrees. According to another embodiment, a gaseous combustion process may be used to tailor the cleaning process. Certain areas of the liner may be masked such that a combustion event sufficient to burn away burrs and an particulate degrees on the surface of the pores may be used to reveal the pores in an unmasked region of the liner. According to yet another embodiment, an abrasive high pressure fluid (such as compressed air/dry ice blast) may be used to provide the selective surface texture. The abrasive high pressure fluid may be implemented with a nozzle that is moved relative to the liner, and pressure is varied depending on the nozzle position in the liner to reveal pores to different degrees.

While the coating 32 on the cylinder bore 30 has been described above with two different surface porosity regions, there may be more than two different surface porosity regions, such as 3, 4, 5, or more different regions. To affect the surface porosity gradients and changes between regions, the pore sizes and degree of revelation will be based on selectively cleaning accordingly. In some embodiments, instead of discrete regions, there may be a gradient of surface porosity along the height of the cylinder bore 30, as dependent on the cleaning process to reveal the pores. The change in surface porosity may be continuous and may be a linear/constant increase/decrease or may be a curve. The change in surface porosity may also be comprised of a plurality of small steps in surface porosity having two or more regions (e.g., 2 to N regions).

Accordingly, a tailored cleaning process to provide a selective surface texture is provided. The process provides a low-cost and rapid cycle-time method to expose pores to varying degrees, such that thermal spray coatings can be used efficiently to reduce weight and production costs. The pores may be revealed to varying degrees according to selected regions of the cylinder bore honed surface region.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method comprising:

spraying a coating on to an engine bore surface;

honing the coated surface to create a honed surface region having a plurality of surface pores and upper, middle, and lower regions; and cleaning the honed surface region to remove material from the surface pores and produce upper, middle, and lower region surface porosities, the middle region porosity being greater than at least one of the upper and lower porosities.

2. The method of claim 1, wherein the middle region average porosity is greater than the upper region porosity and the lower region porosity.

3. The method of claim 1, wherein the cleaning step includes spraying a pressurized fluid on to the honed surface region.

4. The method of claim 3, wherein spraying includes spraying the pressurized fluid through a nozzle with multiple controlled apertures of different diameters.

5. The method of claim 3, wherein spraying includes moving a nozzle with a single aperture relative to the engine bore surface and varying spray pressure of the pressurized fluid based on the region.

6. The method of claim 1, wherein the cleaning step includes masking at least one region of the honed surface and removing the material from surface pores in an unmasked region via gaseous combustion.

7. The method of claim 1, wherein the cleaning step includes spraying an abrasive high pressure fluid on to the honed surface region and varying spray pressure based on the region.

8. The method of claim 7, wherein the abrasive high pressure fluid is compressed air or a dry ice blast.

9. A method comprising:

spraying a coating on to an engine bore surface;

honing the coated surface to create a honed surface region having a plurality of surface pores and a first and second region; and cleaning the honed surface region to selectively remove material from the surface pores and produce a first region average surface porosity greater than a second region average surface porosity.

10. The method of claim 9, wherein the first region is a middle region of the honed surface region, and the second region is an upper and lower ring of the honed surface region.

11. The method of claim 9, wherein the cleaning step includes spraying a pressurized fluid on to the honed surface region.

12. The method of claim 11, wherein spraying includes spraying the pressurized fluid through a nozzle with multiple controlled apertures of different diameters.

13. The method of claim 11, wherein spraying includes moving a nozzle with a single aperture relative to the engine bore surface and varying spray pressure of the pressurized fluid based on the region.

14. The method of claim 9, wherein the cleaning step includes masking one region of the honed surface region and removing the material from surface pores in an unmasked region via gaseous combustion.

15. The method of claim 9, wherein the cleaning step includes spraying an abrasive high pressure fluid on to the honed surface region and varying spray pressure based on the region.

16. The method of claim 15, wherein the abrasive high pressure fluid is compressed air or a dry ice blast.

17. A method comprising:

spraying a coating on to an engine bore surface;

honing the coated surface to create a honed surface region having a plurality of surface pores and upper, middle, and lower regions; and cleaning the honed surface region to remove material from the surface pores from the middle region.

18. The method of claim 17, wherein the middle region is a majority of the honed surface region, and the upper and lower regions are upper and lower rings of the honed surface region.

19. The method of claim 17, wherein the cleaning step includes selectively spraying a pressurized fluid or an abrasive pressurized fluid on to the middle region.

20. The method of claim 17, wherein the cleaning step includes masking the upper and lower regions of the honed surface region and removing the material from surface pores in the middle region via gaseous combustion.

* * * * *